United States Patent [19]

Jernqvist et al.

[11] 4,373,579

[45] Feb. 15, 1983

[54] PLATE HEAT EXCHANGER

[75] Inventors: Åke Jernqvist, Lund; Ulf Bolmstedt, Staffanstorp, both of Sweden

[73] Assignee: Alfa-Laval AB, Tumba, Sweden

[21] Appl. No.: 164,144

[22] Filed: Jun. 30, 1980

[30] Foreign Application Priority Data

Jul. 6, 1979 [SE] Sweden ..... 7905915

[51] Int. Cl.[3] ..... F28F 3/08

[52] U.S. Cl. ..... 165/167

[58] Field of Search ..... 165/166, 167; 159/13 R

[56] References Cited

U.S. PATENT DOCUMENTS 3,106,243 10/1963 Knudsen ..... 165/167

FOREIGN PATENT DOCUMENTS 959916 3/1957 Fed. Rep. of Germany ..... 165/166

116000 3/1946 Sweden ..... 165/167

1240039 7/1971 United Kingdom ..... 165/167

*Primary Examiner*—William R. Cline

*Assistant Examiner*—Theophil W. Streule, Jr.

*Attorney, Agent, or Firm*—Cyrus S. Hapgood

[57] ABSTRACT

A heat exchanger comprises a plurality of first plates clamped in a frame-work. The plates are generally rectangular and have an opening at each of their corners, said opening forming together with corresponding openings of adjacent plates a first manifold duct for a heat exchanging fluid. A plurality of second plates have a recess at one or more of their corners, said recess corresponding to said openings of the first plates. A connection piece connected to said first manifold duct is clamped in the space formed by the recesses. All the plates have an additional opening forming a second manifold duct through which said first manifold duct is connected to the heat exchanging passages.

3 Claims, 6 Drawing Figures

PLATE HEAT EXCHANGER

The present invention relates to heat exchangers of the kind comprising a plurality of plates clamped in a framework and sealed off mutually by means of peripheral gaskets, heat exchanging passages for heat exchanging fluids being formed between the plates. The plates are generally rectangular in shape and have at each of their corner portions an opening which together with corresponding openings of adjacent plates forms a first manifold duct for a heat exchanging fluid.

In conventional heat exchangers of this kind, the heat exchanging media are conveyed to and from the apparatus via tube connections in one or both of the pressure plates between which the heat exchanging plates are clamped by means of tension bolts. In certain cases, the heat exchanger is functionally divided into several sections operating as separate heat exchanger units but clamped in a common frame-work. In such cases, the use of so-called connection plates between the sections is required, the latter plates being provided with tube connections by which the heat exchanging media are conveyed to and from the intermediate sections of the heat exchanger. Heat exchangers arranged in this way are common in the food industry.

A disadvantage of the above-described arrangement is that the production of the connection plates is very expensive. Also, these plates take up a substantial portion of the space in the heat exchanger frame-work, and this portion thus cannot be used for the exchange of heat.

The principal object of the present invention is to eliminate the above-noted disadvantages and to provide a heat exchanger in which the connection plates used heretofore may be omitted so that the exchanger can be produced at a lower cost and is less bulky.

A heat exchanger made according to the invention is characterized in that it comprises a plurality of plates disposed adjacent to each other and each having at one or more of its corners a recess instead of said opening of the other plates, a connection piece being sealingly clamped in the space formed by said recesses and connected to said manifold duct, all the plates having an additional opening forming a second manifold duct through which said first manifold duct is connected to said heat exchanging passages.

The invention will be described in more detail below with reference to the accompanying drawings, in which FIGS. 1 and 2 are diagrammatical plan views of a first embodiment of heat exchanging plates to be used in the plate heat exchanger according to the invention;

Figure 1:
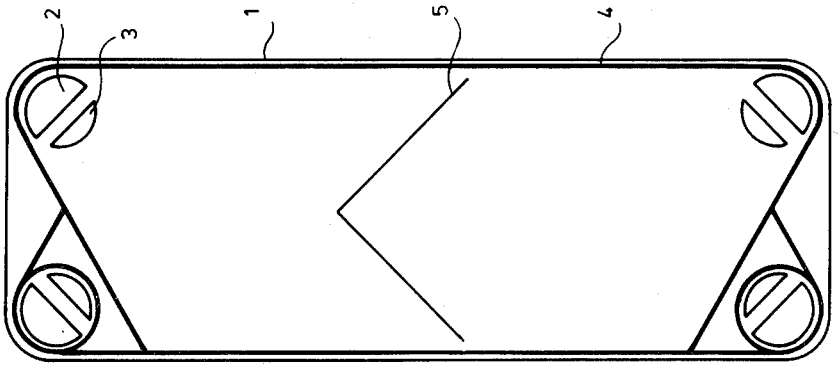

The plate shown in FIG. 1 is a so-called normal plate which differs from a conventional plate in that each of the ports at the corners of the plate comprises an outer opening 2 and an inner opening 3, each of these openings having the shape of a circle segment. The plate is also provided with a rubber gasket 4 and a turbulence-generating corrugation pattern, as indicated at 5.

A plate 6 (FIG. 2) is to be used with the plate 1. The corner portions, including tthe outer openings 2 in FIG. 1, have been removed from the plate 6, and the plate is provided with a differently shaped gasket 7. In other respects the plates 1 and 6 are identical. The plate 6 can be easily manufactured by cutting off the corners of the plate 1.

Figure 3:
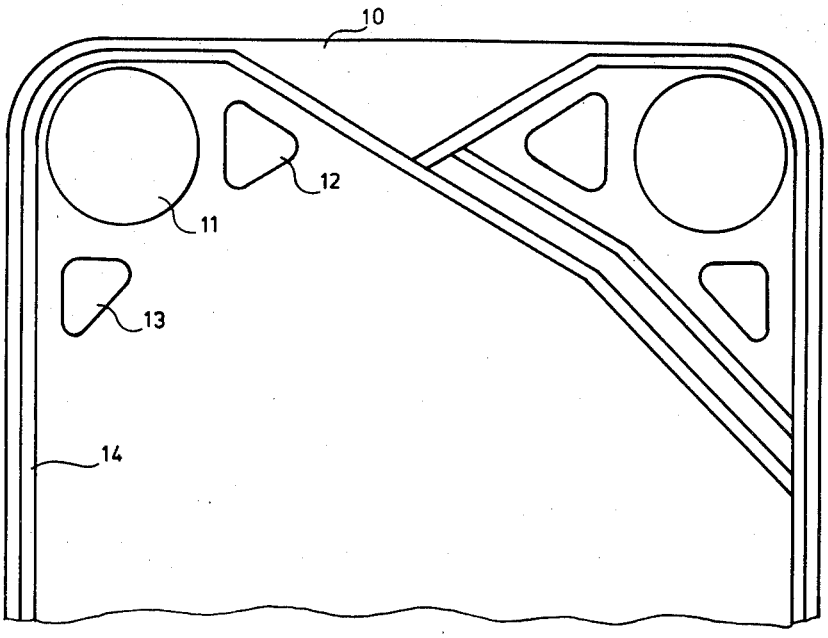
FIGS. 3 and 4 are diagrammatical plan views of a second embodiment of heat exchanging plates, shown only partially.

As shown in FIG. 3, a heat exchanging plate 10 is provided in each of its corners with an outer circular opening 11 and two inner, triangular openings 12, 13. The position of the openings 12 and 13 has been chosen with regard to the best utilization of the sheet material on the one hand and the flow distribution on the other hand. The plate is provided with a gasket 14.

Figure 4:
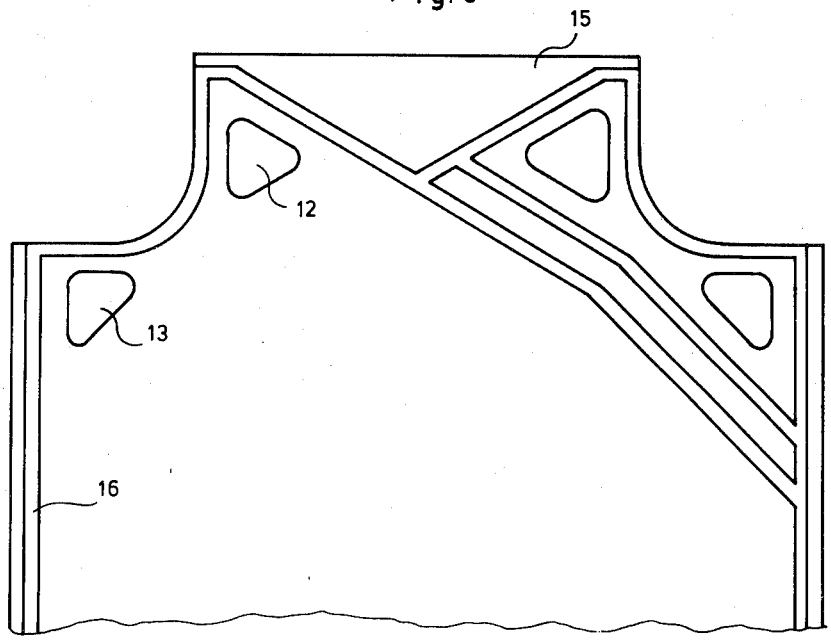

The plate 15 illustrated in FIG. 4 consists of a plate according to FIG. 3 from which the corner portions with openings 11 have been cut away. The plate is also provided with a gasket 16 adapted to the shape of the plate.

Figure 5:
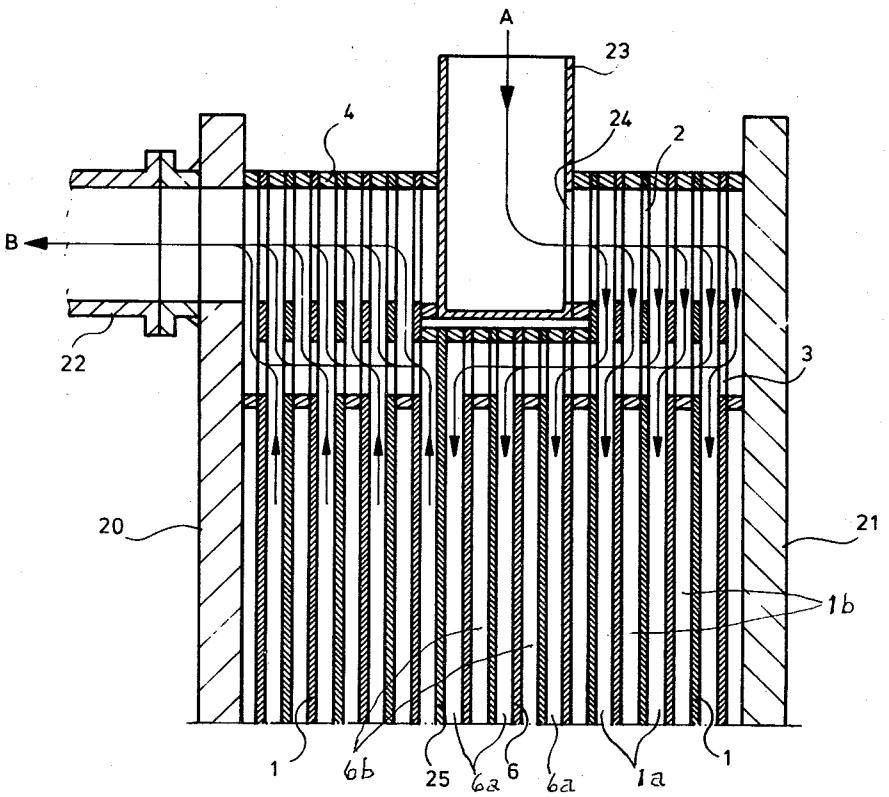
FIG. 5 is a longitudinal sectional view of a portion of a heat exchanger according to the invention.
Figure 6:
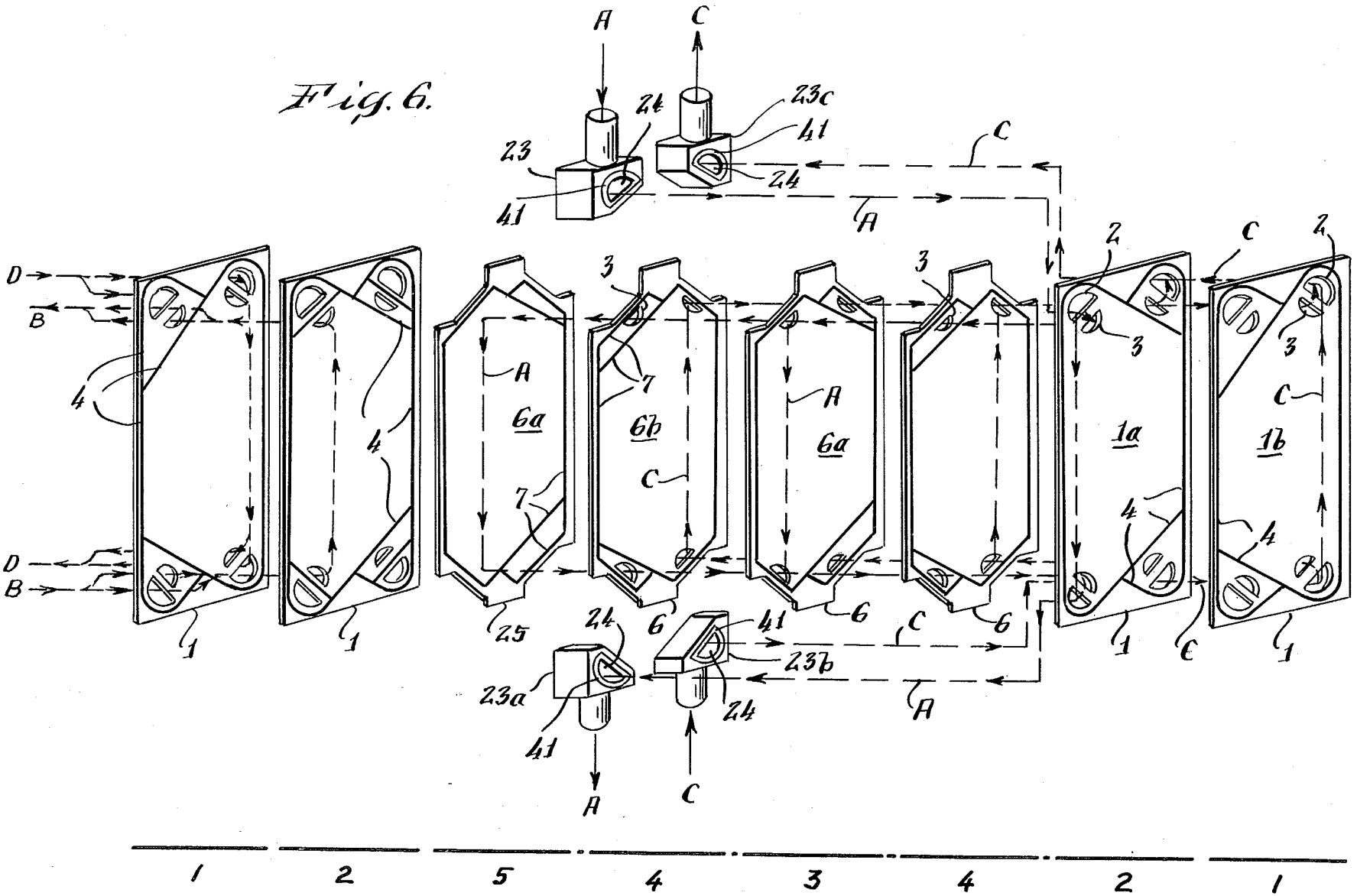
FIG. 6 is an exploded, schematic view of a heat exchanger with plates according to FIGS. 1 and 2 and with parts omitted for the sake of clarity, FIG. 6 showing an example of the flow patterns.

In FIG. 5, which shows a corner portion of a heat exchanger according to the invention, the heat exchanger comprises two pressure plates 20 and 21, one of which has a connection tube 22. Between the pressure plates, which are clamped by means of tension bolts (not shown), is a series of heat exchanging plates which for the sake of simplicity are assumed to be of the embodiment shown in FIGS. 1 and 2. The plate pack comprises a series of normal plates 1 according to FIG. 1 provided at each end of the heat exchanger, and a series of plates 6 according to FIG. 2 disposed therebetween. A connection piece 23 is clamped in the plate pack together with the plates 1 and 6 and is located in the recess formed by plates 6 at an upper corner of the plate pack. The connection piece 23 is provided with an opening 24 having a shape corresponding to the shape of the outer openings 2 of the plates 1, opening 24 being aligned with openings 2 in said upper corner and being sealed from adjacent plates by means of gasket 41 (FIG. 6).

As appears from the drawing, the heat exchanger is divided into two sections by means of a partition plate 25 which lacks openings. As shown by arrows, a heat exchanging fluid A enters through the connection piece 23 and its opening 24 into the manifold duct formed by the outer openings 2 of the plates 1 to the right of partition 25. The fluid proceeds therefrom to the manifold duct formed by the inner openings 3 and is distributed therefrom to each of the alternate heat exchanging passages 1*a* and 6*a* of the right-hand section of the heat exchanger. The fluid is conveyed from the heat exchanger via a similar connection piece 23*a* (FIG. 6) located in the recess formed by plates 6 in a lower corner of the pack.

A second heat exchanging fluid B flows through the left hand section of the heat exchanger and escapes via the conventional tube connection 22 (FIG. 5).

Due to the arrangement according to the invention in which fluid A is conveyed via openings 3 even to the passages 6*a* between plates 6, the whole space between the pressure plates 20, 21 is utilized for the exchange of heat, and the connection piece 23 does not cause any reduction of the effective heat exchanging area of the apparatus.

Of course, many modifications of the described apparatus can be made within the scope of the invention. Thus, the heat exchanger can be provided with a plurality of sections, each having connection pieces 23 by which the fluids are conveyed to and from the heat exchanging passages. The conventional tube connection 22 may be omitted, the heat exchanging fluids being conveyed to and from the apparatus exclusively via connection pieces 23. These may also be provided with double openings 24 facing opposite directions.

Figure 2:
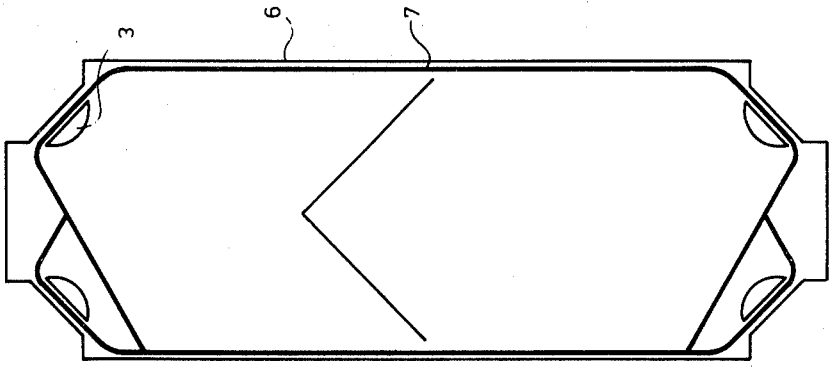

The heat exchanger described with reference to FIG. 5 has been assumed to be equipped with plates according to FIGS. 1 and 2 but may as well be provided with plates according to FIGS. 3 and 4. These plates operate in the same way, the difference being that the triangular openings 12, 13 form two inner manifold ducts.

For technical reasons of manufacture, the plates 6 and 15 are preferably made quite symmetrical, i.e., with all four corner portions cut off. In cases when it is not desirable to use all the corners for the connection of pipelines, a filler piece may be inserted instead of the connection piece 23, said filler piece being sealed against adjacent plates and blocking the opening 2 or 11 thereof and in addition withstanding the pressure forces required to obtain satisfactory sealing between the heat exchanging plates at the corner portions thereof.

It will be understood that in FIG. 5, fluid A is in heat exchange relation with another fluid flowing through passages 1*b* and 6*b* which alternate with passages 1*a* and 6*a*, respectively. This is illustrated in FIG. 6 where the other fluid C enters and leaves the plate pack via connection pieces 23*b* and 23*c*, respectively, located at the remaining two corners of the pack. It will also be understood that adjacent plates 1 are reversed relative to each other so that their corrugation patterns cross each other, as is conventional; and the same is true of plates 6.

For simplicity, the plates 1 and 6 in FIG. 6 are fewer in number than as shown in FIG. 5. In FIG. 6, the medium B flowing through the left-hand section of the exchanger (FIG. 5) is in heat exchanging relation with a medium D. Because of the partition plate 25 as shown in FIGS. 5 and 6, the media B and D exchange heat with each other independently of the heat exchange between media A and C.

We claim:

1. A heat exchanger comprising a first series of plates, a frame-work in which the plates are clamped adjacent to each other, peripheral gaskets located between adjacent plates and forming therewith a first series of heat exchanging passages for heat exchanging fluids, each plate being generally rectangular in shape and having at each of its corner portions an opening which forms with corresponding openings of adjacent plates a first manifold duct for one of said fluids, a second series of plates clamped adjacent to each other in said frame-work and each being generally rectangular in shape, peripheral gaskets located between adjacent plates of said second series and forming therewith a second series of heat exchanging passages for said fluids, each plate of said second series having one of its corners cut away to form a recess corresponding to a said opening in the plates of the first series, said recesses forming a space aligned with a said manifold duct, and a connection piece sealingly clamped in said space between said plates and communicating with said manifold duct, the plates of both said series each having a separate opening forming a second manifold duct, said first manifold duct being connected to heat exchanging passages of both series through said second manifold duct.

2. The heat exchanger of claim 1, in which each plate of said second series has a said recess at each of its other three corners for accommodating three more connection pieces.

3. The heat exchanger of claim 1, in which plates of said second series are provided with identical recesses at each of their four corners and are symmetrical.

* * * * *